United States Patent [19]

Kielhoffer

[11] Patent Number: 4,492,214

[45] Date of Patent: Jan. 8, 1985

[54] ARCHERY BOW WITH ARROW REST THEREFOR

[76] Inventor: Karey Kielhoffer, P.O. Box 992, Morongo Valley, Calif. 92256

[21] Appl. No.: 407,706

[22] Filed: Aug. 13, 1982

[51] Int. Cl.[3] ..... F41B 5/00

[52] U.S. Cl. ..... 124/24 R; 124/41 A

[58] Field of Search ..... 124/41 A, 24 R, 88, 124/86

[56] References Cited

U.S. PATENT DOCUMENTS

| | | | |
|---|---|---|---|
| 1,961,517 | 6/1934 | Klopsteg | 124/24 R |
| 3,871,352 | 3/1975 | Stanislawski et al. | 124/41 A |
| 4,299,195 | 11/1981 | Norris | 124/24 R |
| 4,347,829 | 9/1982 | Okupniak | 124/41 A X |

*Primary Examiner*—Richard J. Apley

*Assistant Examiner*—William R. Browne

[57] ABSTRACT

An overdraw arrow unit includes a flat elongated bar element having a first planer surface forming a bow attaching portion at one distal end and a second planer surface forming a rest portion at the opposite distal end, with said two surface portions connected by an offset portion positioning said surfaces in an offset but parallel relationship and a U-shaped base rest element attached at the bottom edge of the rest portion along with a central arrow rest located above the base rest element whereby said attaching portion can be secured to an archery bow with the unit extending rearwardly toward the bow string to provide a secondary arrow rest rearwardly from the bow proper allowing the use of shorter arrows with the same bow string draw by an archer.

5 Claims, 4 Drawing Figures

ARCHERY BOW WITH ARROW REST THEREFOR

BACKGROUND

Numerous factors affect the accuracy of arrow dispatched by a bow. While a bow and arrow system may look simple, complex forces are at work when an archer releases an arrow from a bow. First, the bow string tracks the center line of the bow, thus the bow itself obstructs the most desirable path to the arrow unless the bow includes an arrow window to eliminate for this factor. Old long bows have been modernized and newer recurved bows along with the compound bow, now all have arrow windows with an arrow shelf allowing an arrow to track true with the bow string path.

Next, the drag of the archer's fingers on the bow string when the latter is released, pulls the bow string out of alignment with the limbs of the bow developing lateral forces on the arrow nocked on the bow string, as the arrow tracks through the window.

However, the most complex forces occur on the arrow as the archer releases the bow string. The sudden propulsive force on the arrow nocked on the bow string causes the arrow to flex. In fact, the flex is so significant that the feathers do not touch the front arrow support on the bow. This flexing is sometimes referred to as "archer's paradox". The arrow seems to bend around the rest or shelf on which its head was at rest before the archer released the bow string. This flexing develops an oscillation in the shaft of the arrow during its flight and this oscillation, and archer's paradox, is more pronounced as the length of the arrow shaft increases.

Also, the feathers or vanes of the arrow can contact the sidewall of the window of the bow introducing slight deflecting forces on the rearend of the arrow which decreases accuracy.

Arrow rests with tongues and spring-loaded plungers, such as shown in U.S. Pat. No. 3,865,096 have helped to reduce the problems resulting from deflection caused by the feathers or vanes on the arrows, especially in arrows using plastic vanes in place of feathers. Such devices have helped increase the accuracy of archers. Even sophisticated shock absorbers, such as those shown in U.S. Pat. No. 3,757,764 have been employed to help stabilize the dynamics of an arrow as it leaves the bow.

The current invention can reduce the above problems by a secondary rest (overdraw rest) located aft of the bow nearer the bow strings which allows the archer to use shorter arrows. This overdraw rest allows the archer to have the full draw of the bow string while using shorter arrows without the loss of safety and combined with improved accuracy.

Thus, it is the general purpose of this invention to provide archers with a new device which allows the use of shorter arrows to achieve greater accuracy with bows.

SUMMARY OF THE INVENTION

An overdraw arrow rest unit comprises the flat elongated bar element with a central offset having a first planer surface at one end for attaching it to a bow and a second planer surface forming a rest portion at the opposite end with said surfaces connected by an offset portion positioning said first and second surfaces in an offset but parallel relationship, a U-shaped based rest element attached at the bottom edge of the rest portion and an arrow rest means located in the central area of the rest surface which unit, when mounted on a bow, allows the use of shorter arrows nocked in the bow string to be dispatched from a bow with full bow string draw for greater accuracy.

DESCRIPTION OF THE PREFERRED EMBODIMENT

Figure 1:
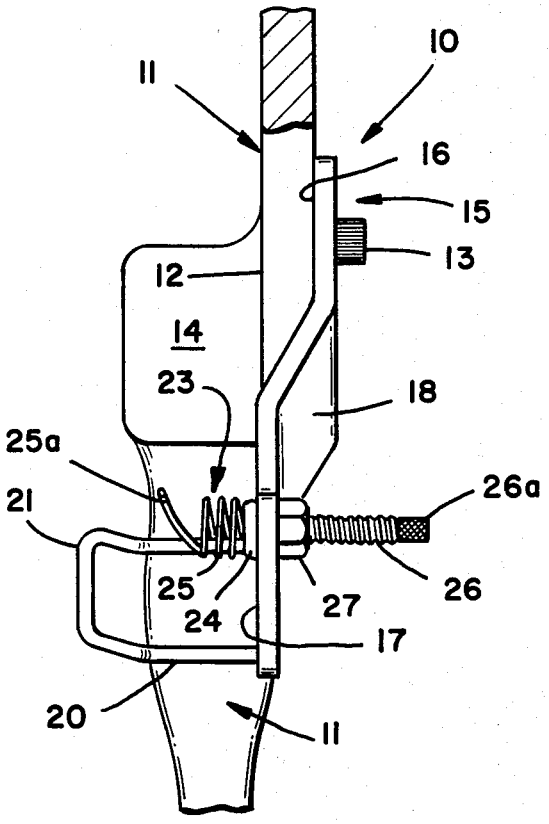
FIG. 1 is a perspective of a bow with the overdraw arrow rest unit attached with the limbs of the bow broken away.

The novel overdraw arrow rest unit 10 is illustrated in FIG. 1 attached to a bow 11 at a location adjacent to the arrow window 12 of the bow. A bolt 13 that screws into the bow on the outside of the arrow windows as illustrated in FIG. 1 is used to mount the overdraw arrow rest unit on the bow, as shown.

Figure 4:
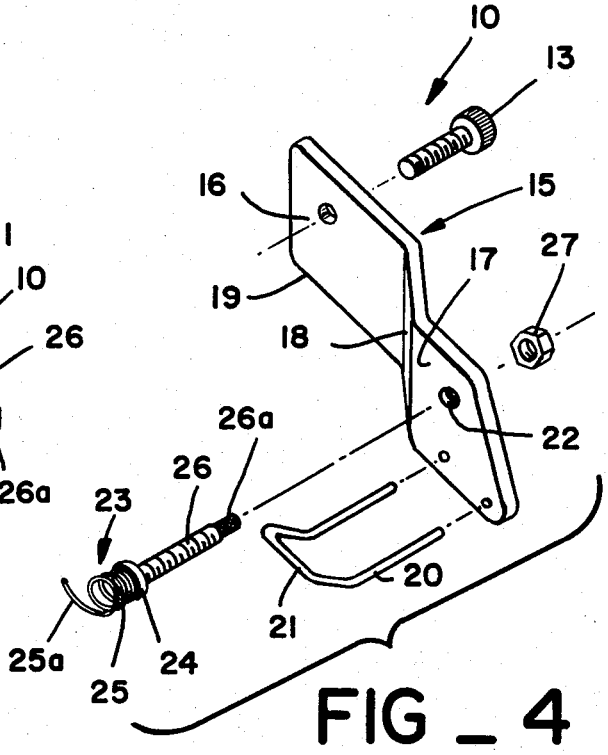

The actual components of the overdraw arrow rest unit 10 can best be seen in FIG. 4 showing it in exploded perspective. Its principal part is a flat elongated bar 15 which includes compounded bends to form an offset so that the bow attaching surface 16 is offset but still parallel to the rest surface 17. These two flat surfaces are connected by the offset portion 18 of the elongated bar which is usually made of aluminum or other lightweight metal but which has sufficient rigidity so that when the bow attaching surface 16 is secured to the outside of the arrow window 12 with bolt 13 the overdraw arrow rest 10 will not flex when it is used. The unit functions as a rigid extension of the bow's arrow shelf.

The rest surface 17, as indicated above, is parallel but offset from the bow attaching surface 16. The offset is sufficient so that the rest surface is aligned parallel with the vertical face of the arrow window 12 in the bow, as best shown in FIG. 1.

Figure 3:
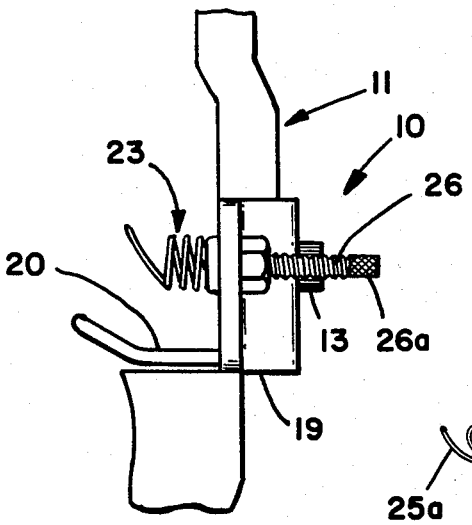
FIG. 3 is an end elevation of the overdraw arrow rest shown in FIG. 1 as used by an archer using the overdraw rest; and, FIG. 4 is an enlarged exploded perspective of the arrow rest unit as shown in FIG. 1.

On the rest surface 17 along its lower or bottom edge 19 is a U-shaped safety or base rest 20. This base rest is shown constructed of small diameter barstock, but could alternatively be constructed of a plate. However, the barstock is preferred since it provides sufficient rigidity with less weight. As can be seen in FIG. 3 the base 21 of the U-shaped frame bent upwardly to prevent an arrow falling off this base rest. As can be appreciated, the purpose of this base rest is for safety, preventing an arrow that slips off the arrow rest, described subsequently, from being dispatched without control. Also it can be seen in FIG. 3 this rest is aligned so that it is oriented parallel with a plane extending from the bow's arrow shelf 14 as can best be seen in FIG. 1 and FIG. 3. The ends of this U-shaped member are received in holes in the bar element and are secured in the holes.

Figure 2:
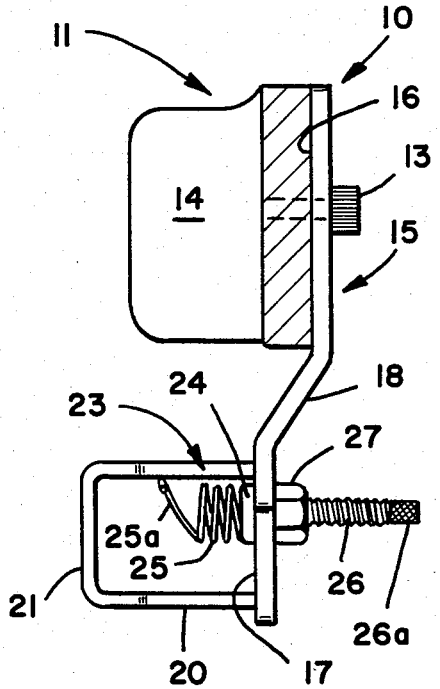
FIG. 2 is a top plan of the arrow rest unit shown in FIG. 1 with the top portion of the bow sectioned.

Centrally disposed in the overdraw surface 17 is an aperture 22. It is centered above the base rent. This aperture is provided for the primary arrow rest, and in the drawings a springy primary arrow rest 23 is shown. This springy arrow rest consists of a head button 24 having a coiled spring 25 attached thereto with the outer coil 25A opened to form a laterally projecting wire to support the head-end of an arrow. Head 24 is attached to a shaft 26 which is threaded and this shaft can be inserted through aperture 22 and secured with nut 27, as shown in FIG. 1 and FIG. 3. The end of the shaft includes a knurled portion of 26*a* which is used to adjust the orientation of the open coil 25*a* before nut 27 is cinched against the bar element to lock it in a selected orientation. Referring to FIG. 2, the orientation of the over rest unit 10 on a bow 11 is illustrated showing the parallel alignment of the over rest surface 17 with the vertical surface of the window 12 of the bow.

The distal end of the elongated bar element 15 at the rest end is relieved at approximately a 45° angle starting from the location of the attachment of the base rest 20 which normally is secured in the bottom edge of the rest portion, toward the top edge of the unit. This relief can be seen in the drawings. It increases the archer's visibility and decreases the arrow's vane contact with the unit.

Also, it can be appreciated that the springy arrow rest, illustrated in the current overdraw rest, can be replaced with other types of arrow rests if an archer desires.

Having described the invention, it can be appreciated that shorter arrows can be utilized without changing the draw of the bow string, which circumstances allows an archer to improve his accuracy and increase arrow flight due to the fact there is less oscillation in the arrow shaft and the arrow lighter.

What is claimed is:

1. An overdraw arrow rest unit comprising:

a flat elongated bar element with a central offset between its ends, said bar element having a first planer surface at one end for attaching it to a bow and a second planer surface forming a rest portion at its opposite end with said two surface portions connected by said central offset, said first and second surfaces being in an offset spaced apart parallel relationship;

a base rest element fixedly attached to the bottom edge of the rest portion of said elongated bar element adjacent to its distal end and projecting perpendicularly from said second planer surface, said rest element having an upwardly directed distal end operable to prevent arrows from sliding off said rest element;

an arrow rest means located between said first planar surface and said base rest element in the central position of said rest surface and secured therein operable to provide a support for resting the head portion of an arrow thereon; and, attaching means operable to fixedly attach said first planer surface to a bow whereby said unit can be attached to a bow to provide an arrow rest between a bow and a bow string to allow an archer to use shorter arrows and also to provide a safety base rest element between a bow string and an arrow rest.

2. An overdraw arrow rest unit as defined in claim 1 wherein the base rest element is formed of barstock and is configured in a U-shape.

3. The overdraw arrow rest unit defined in claim 1 wherein the arrow rest means which is centrally attached in the rest surface includes a coiled spring with a loop thereof opened to provide a primary rest for the head end of an arrow.

4. A combination of a bow and with an extended overdraw arrow rest unit for shorter arrows comprising:

a bow with a string attached between its limbs having a central grip;

a flat elongated bar element with a central offset between it ends, said bar element having a first planar surface at one end for attaching it to said bow and a second planer surface forming a rest portion at its opposite end with said two surface portions connected by said central offset, said first and second surface being in an offset spaced apart parallel relationship;

a base rest element fixedly attached to the bottom edge of the rest portion of said elongated bar element adjacent to its distal end and projecting perpendicularly from said second planer surface, said rest element having an upwardly directed distal end operable to prevent arrows from sliding off said rest element;

an arrow rest means located between said bow and said rest element secured in the central portion of said rest surface operable to provide a support for resting the head portion of the arrow thereon; and, attaching means operable to fix said first planer surface to said bow whereby said unit is fixedly attached to said bow to provide an arrow rest between said bow and its bow string to allow an archer to use shorter arrows and to also provide a safety base rest element between the bow string and the arrow rest.

5. The combination found in claim 4 wherein the offset between the parallel surfaces is sufficient to align the parallel surface of the rest surface with the vertical surface forming an arrow window on the bow.

* * * * *